US005481781A

United States Patent [19]

Weber

[11] Patent Number: 5,481,781

[45] Date of Patent: Jan. 9, 1996

[54] ROLLERED NOZZLE

[75] Inventor: Vincent L. Weber, North Lawrence, Ohio

[73] Assignee: The Hoover Company, North Canton, Ohio

[21] Appl. No.: 183,870

[22] Filed: Jan. 21, 1994

[51] Int. Cl.[6] ..... A47L 9/04

[52] U.S. Cl. ..... 15/378; 15/422

[58] Field of Search ..... 15/378, 418, 419, 15/420, 421, 422

[56] References Cited

U.S. PATENT DOCUMENTS

| | | | |
|---|---|---|---|
| 959,721 | 5/1910 | Cummings et al. . | |
| 1,291,802 | 1/1919 | Drake . | |
| 1,708,242 | 9/1929 | Simpson . | |
| 1,904,974 | 4/1933 | Hoover . | |
| 1,933,645 | 11/1933 | Vine . | |
| 2,017,893 | 10/1935 | Boettler . | |
| 2,157,077 | 5/1939 | Kroenlein | 15/419 X |
| 2,278,382 | 3/1942 | Ross | 15/419 X |
| 2,701,892 | 2/1955 | Mingus | 15/420 X |
| 3,102,289 | 9/1963 | Norris | 15/421 X |
| 3,260,042 | 7/1966 | Hanson et al. | 56/249 |
| 3,605,172 | 9/1971 | Damasco | 15/419 |
| 4,050,112 | 9/1977 | Saxon . | |
| 4,138,762 | 2/1979 | Jost | 15/419 |
| 4,809,395 | 3/1989 | Fleischhauer . | |

FOREIGN PATENT DOCUMENTS

| | | |
|---|---|---|
| 459029 | 8/1949 | Canada . |
| 839459 | 4/1970 | Canada . |
| 1428434 | 2/1971 | Germany . |
| 926968 | 5/1963 | United Kingdom . |
| 1318099 | 5/1973 | United Kingdom . |
| 2199487 | 7/1988 | United Kingdom . |

*Primary Examiner*—Chris K. Moore

[57] ABSTRACT

A vacuum cleaner is provided with a nozzle having front and rear rollers that extend for, essentially, the width of the nozzle from side to side. Ideally, these rollers are mounted at least partly within the vacuumized envelope formed by the nozzle.

9 Claims, 3 Drawing Sheets

ROLLERED NOZZLE

BACKGROUND OF THE INVENTION

1. Field of the Invention

This invention relates to vacuum cleaners and, more specifically, to a manner of mounting the supporting rollers for the nozzle of such a cleaner.

2. Summary of the Prior Art

Vacuum cleaners are known which have extended roller trains of varying diameter rollers which are disposed adjacent their nozzle to thereby provide more and more roller support as the nozzle sinks into the floor covering being cleaned. Vacuum cleaners nozzles are also known which provide, both, relatively narrow traction area rollers outboard of and behind a nozzle opening for these nozzles. Somewhat extended length rollers are also known for use as a low friction support means for canister cleaners. An extended length roller is even known for its use with a hand lawn mower but no vacuum cleaner nozzle is known which is arranged to advantageously use extended length rollers for the direct support of a nozzle to thereby reduce the pushing effort of the vacuum cleaner associated with this nozzle.

Accordingly it is an object of this invention to provide elongated support rollers for a vacuum cleaner nozzle.

It is art additional object of the invention to mount these rollers in close proximity to the nozzle opening of a suction nozzle.

It is a further object of the invention to mount at least one elongated support roller on a suction nozzle so that it extends along the suction opening of the nozzle.

It is a still further object of the invention to provide elongated supporting roller means within the suction envelope formed by a suction nozzle.

It is also an object of the invention to provide an improved roller system for a suction nozzle.

SUMMARY OF THE INVENTION

A suction nozzle is provided with front and rear rollers that extend,, essentially, for the length of the suction opening, These rollers are journalled in end side pieces for the suction nozzle and situated in the suction envelope of the nozzle by being placed inboard of covering suction lips extending downwardly from front and rear walls of the nozzle.

BRIEF DESCRIPTION OF THE DRAWINGS

Reference may now be had to the accompanying Drawings for a better understanding of the invention, both as to its organization and function, with the illustration showing a preferred embodiment, but being only exemplary, and in which.

DETAILED DESCRIPTION OF THE INVENTION

Figure 1:
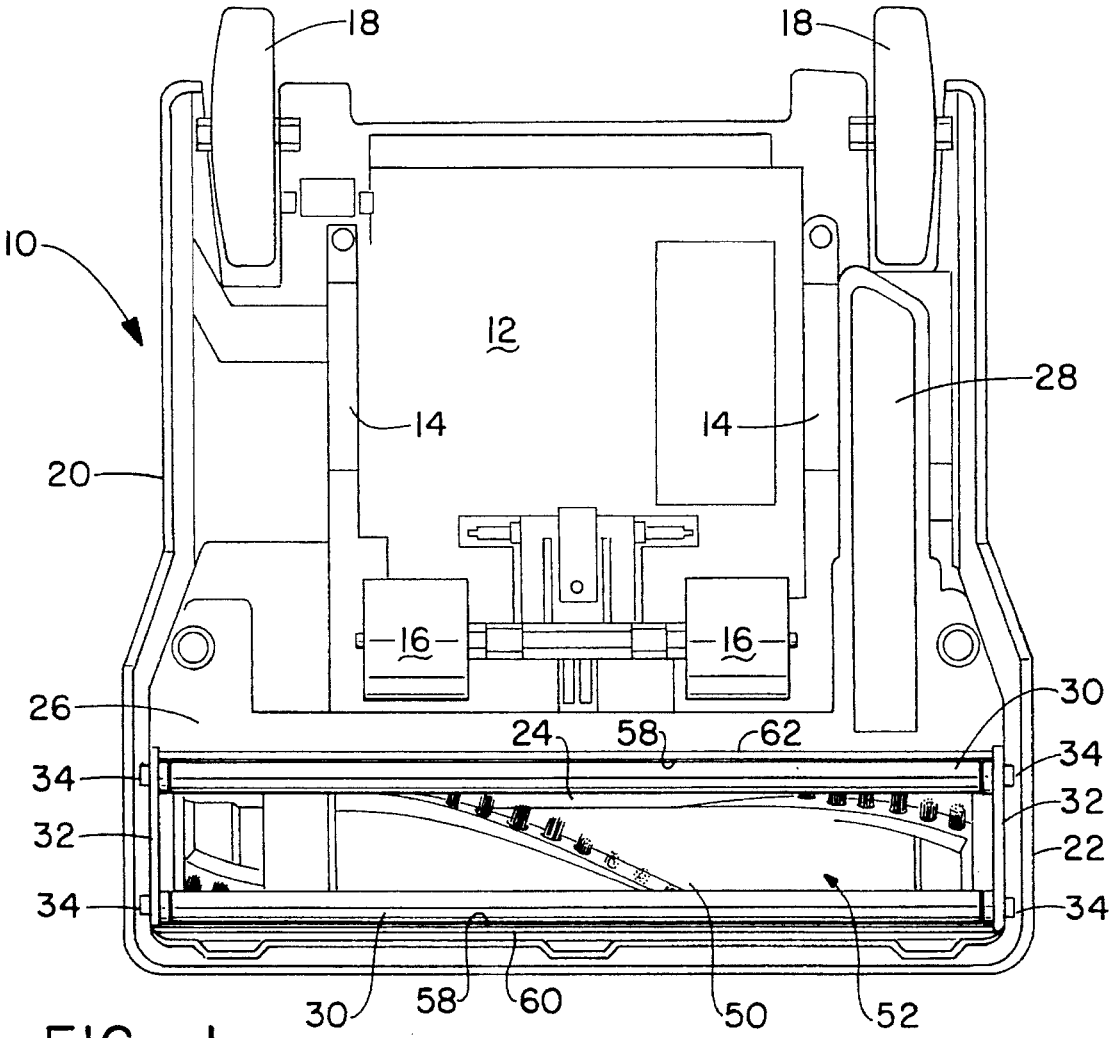
FIG. 1 is a bottom plan view of a nozzle incorporating the invention.
Figure 2:
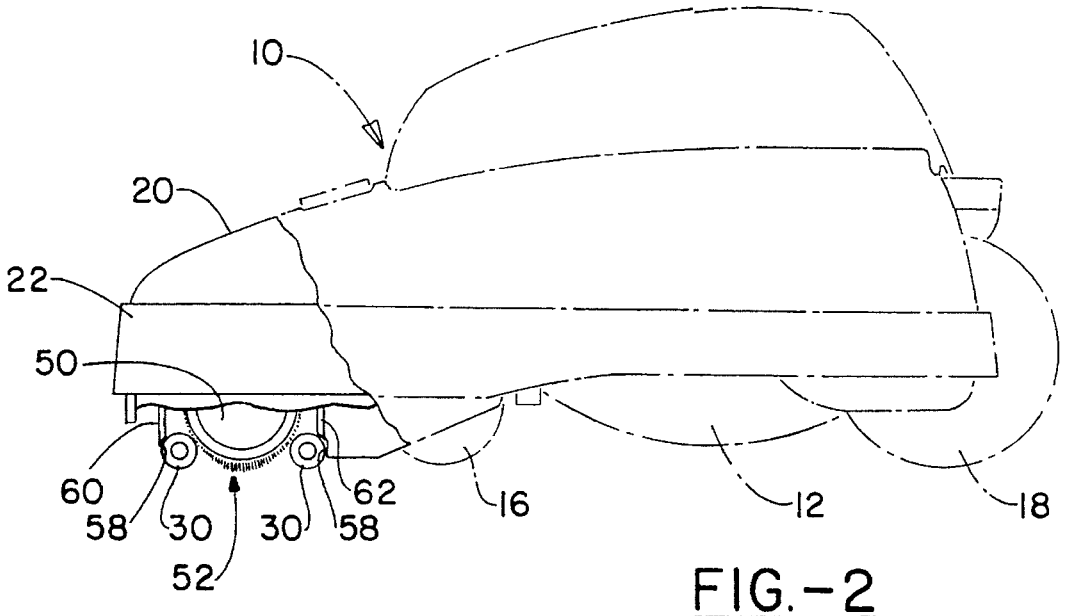
FIG. 2 is a side elevational somewhat schematic view of the same nozzle with parts broken away and with part of the nozzle shown in phantom.
Figure 3:
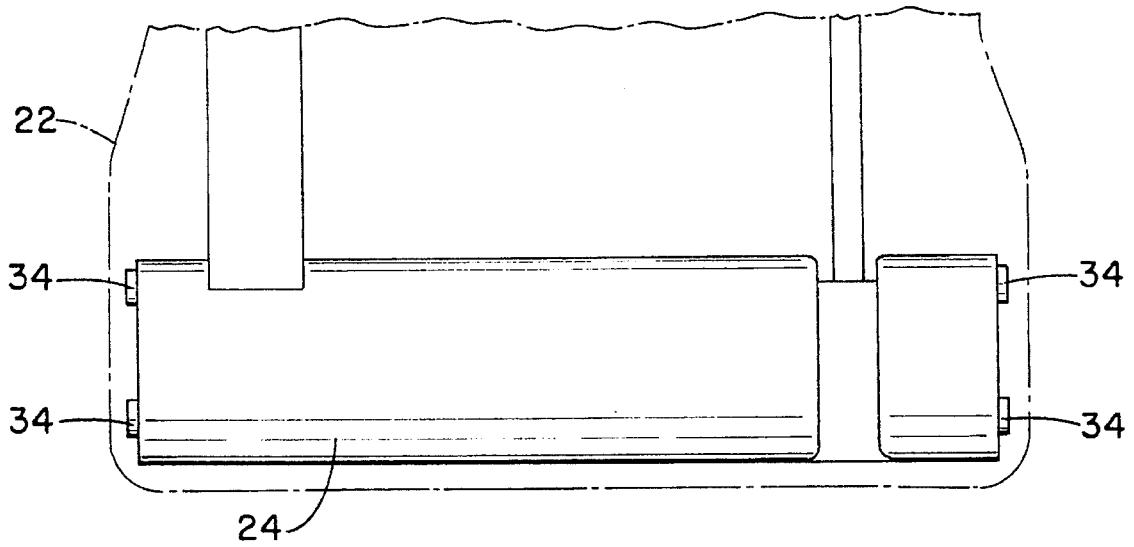
FIG. 3 is somewhat schematic, fragmentary top plan view of the agitator and extended roller end mountings.

There is shown in FIG. 1 a vacuum cleaner nozzle 10 having a rearwardly disposed motor 12 conventionally pivoted thereto and carried by a cleaner handle (not shown) and connected conventionally to the nozzle by motor bosses 14, 14. A pair of ground engaging front rollers 16, 16 are carried by the motor 12, with the motor then pivotally supporting the suction nozzle 10 at its rear through the pivoting bosses and with the nozzle limited in its downward pivoting by engagement of the nozzle 10 with the motor 12 or any height elevation means (not shown) disposed therebetween.

Figure 4:
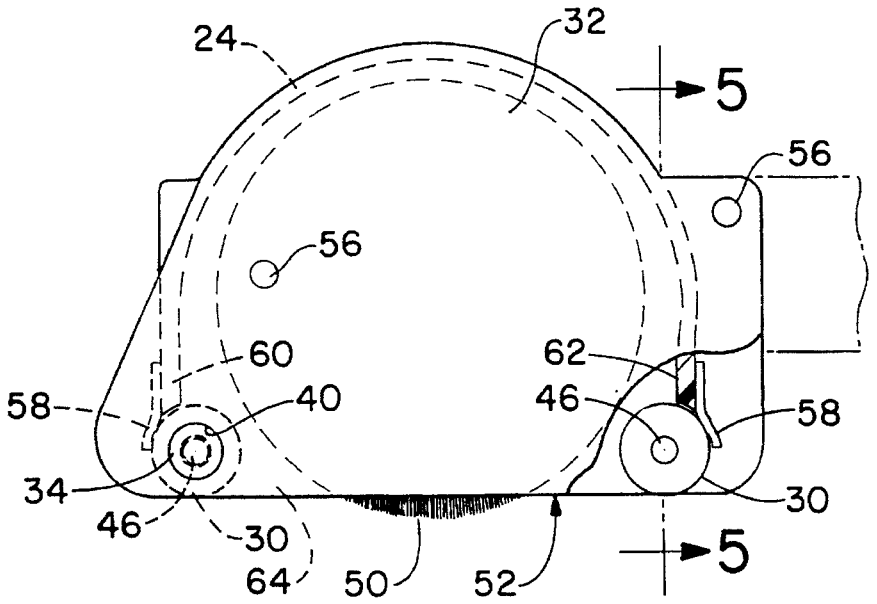
FIG. 4 is an enlarged elevational view of one end of the nozzle arrangement, partly broken away, and showing the extended rollers and lip seals.

The suction nozzle 10 also includes a pair of rear roller wheels 18, 18 which are mounted with a main body 20 of the suction nozzle over which is mounted a hood 22 of the suction nozzle 10. The main body 20, at its front forms an agitator chamber 24 of generally arched configuration (FIG. 4) which is closed at its bottom by a bottom plate 26 including a belt protecting, rearwardly extending relatively narrow section 28.

Figure 5:
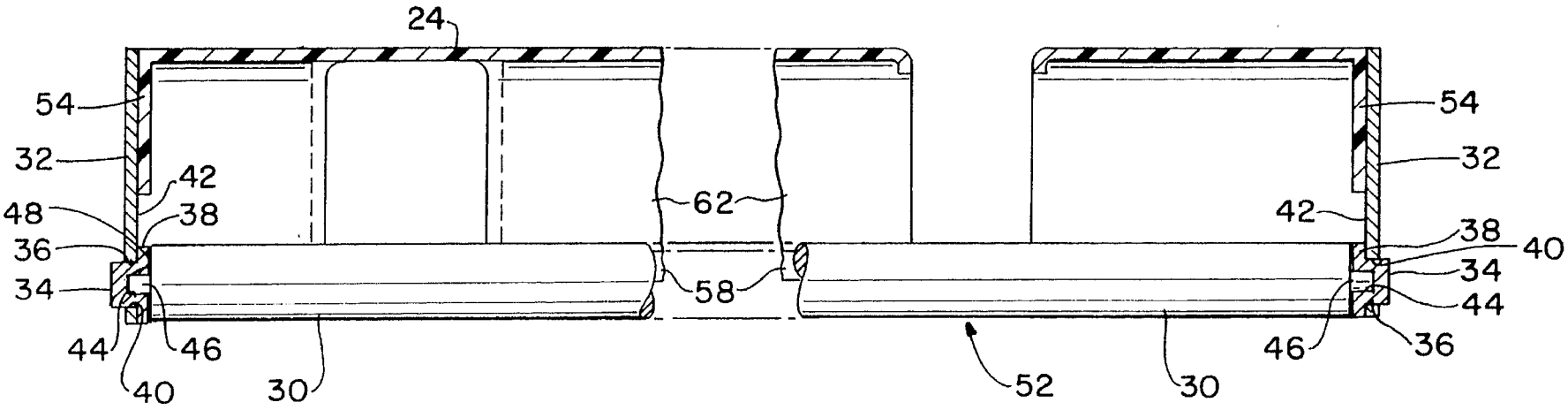
FIG. 5 is a front elevational cross-sectional view of a portion of the nozzle taken on line 5—5 of FIG. 4 and showing an extended roller and its bearing mounting.

At the front of the suction nozzle 10, a pair of nozzle rollers 30, 30 which are journalled in side pieces 32, 32 of the agitator are captivated in bearing caps 34, 34 that extend into side pieces 32, 32. The bearing caps are hat shaped (FIG. 5) and include a roller receiving blind bore section 36 surrounded by a rim portion 38. The bearing caps 34, 34 which, ideally, may be made of sintered bronze, are press fit into bores 40, 40 in the side pieces by the blind bore sections 36, 36 being received compressingly therein and with the rim portions 38, 38 limiting the depth of insertion of the blind bore sections 36, 36 into the bores 40, 40. The bearing caps 34, 34 are disposed, when mounted in agitator chamber side pieces 32, 32, with the blind bore sections 36, 36 disposed outwardly and the rim portions 38, 38 abutting against internal faces 42, 42 of the side pieces 32, 32.

A bore 44 in blind bore section 36 of each bearing cap 34 pilotingly and bearing receives an outer, centered and axially extending stub shaft 46 integral with roller 30 with one situated at each of its ends. An outer wall 48, again on each end of the roller 30, proper, may limit it sideward movement by engagement with an inside surface on bearing cap 34.

The rollers 30, 30 are disposed behind and forward of an agitator 50 within a suction opening 52 so as to extend parallel thereto for substantially the full length of it and the suction opening 52 (FIG. 1). It is provided at the bottom of the agitator chamber 24 and communicates with the floor covering being cleaned. The agitator 50 is bearing received in side walls of main body 20 in a conventional manner 1 (not shown) such as side walls 54, 54 of agitator chamber 24.

These same side walls mount the side pieces 32, 32 by the use of screws, bolts or the like (not shown) which extend through bores 56, 56 formed in side pieces 32, 32 and then into or through the side walls 54, 54 of agitator chamber 24.

A pair of lip seals 58, 58 are disposed on the front and back sides of the agitator chamber 24 so as to extend downwardly therefrom and overlap their respective elongated rollers 30, 30. These lip seals may take the form of a thin elastomeric strip that extends for substantially the full length of its respective elongated roller 30 and may be, e.g., glued for mounting to forward and rearward wall portions 60, 62 of agitator chamber 24. The forward and rearward wall portions 60 and 62 are offset inwardly (relative to agitator chamber 24) from the outer peripheries of the rollers 30, 30 so that the lip seals are elastically deformed outwardly by the periphery rollers to provide a seal therebetween. The lip seals 58, 58 also extend downwardly to substantially near the center of the rollers 30, 30, from top to boredom, to aid in this sealing. This overall configuration of the seals and rollers, along with the inner confines of the agitator chamber 24, places the rollers 30, 30 within a sheltered envelope 64 which is constantly under suction when the cleaner of which suction nozzle 10 is a part is operating to maintain cleaning efficiency even though mechanical effort is decreased.

The bottom sides 66, 66 of the side pieces 32, 32 are at the same level as the bottom outer periphery of the rollers 30, 30 to aide in providing a seal for the suction nozzle 10 and maintaining the integrity of the suction envelope 64. These sides are made relatively thin so they have a tendency to sink into the floor carpeting undergoing cleaning so that the easy movement of the suction nozzle 10 by the rollers 30, 30 is facilitated.

It should be clear from the foregoing description of the invention that all the attendant advantages set out have been fulfilled. It should also be clear that many changes could obviously be made to the inventive concepts herein disclosed which would still fall within its spirit and purview. For example: the rollers could extend below the remainder of the nozzle if less cleaning efficiency was acceptable; the seals could be made integral with the agitator chamber with some loss of sealing unless the chamber was elastomeric; and the roller mounting end plates could also be made integral with the agitator chamber structure. Other changes would readily occur to an artisan practicing in this art.

What is claimed is:

1. A suction nozzle for a cleaner having:

a) an agitator chamber;

b) a suction opening for said nozzle;

c) a pair of rollers mounted in said agitator chamber and extending downwardly into said suction opening;

e) said agitator chamber including an agitator;

f) said rollers disposed, one forwardly and one rearwardly of said agitator;

g) said agitator chamber including sealing means for sealing against said rollers to help maintain an envelope for suction within said suction nozzle;

h) said sealing means taking the form of a pair of elastomeric sealing lips engaging resiliently against said rollers;

i) said rollers being substantially elongated; and j) said sealing lips also being substantially elongated to extend along said rollers;

k) said agitator chamber including side walls;

l) said side walls having bottom terminations; and m) said elongated rollers having a bottom outer periphery aligned with said bottom terminations.

2. The suction nozzle for a cleaner as set out in claim 1 wherein: a) said agitator is a driven agitator.

3. The suction nozzle for a cleaner as set out in claim 1 wherein:

a) the diameter of each of said rollers is small in comparison to the diameter of said agitator.

4. A suction nozzle for a cleaner having:

a) an agitator chamber;

b) a suction opening for said nozzle;

c) a pair of rollers mounted in said agitator chamber and extending downwardly into said suction opening;

d) said agitator chamber including an agitator;

e) said rollers being disposed one forwardly and one rearwardly of said agitator;

f) said agitator chamber including sealing means for sealing against said rollers to help maintain an envelope of suction within said suction nozzle;

g) said sealing means taking the form of a pair of elastomeric sealing lips engaging resiliently against said rollers;

h) said agitator being a brush carrying agitator; and i) said rollers have diameters greatly smaller than the diameter of said agitator.

5. The suction nozzle of claim 4 wherein:

a) said agitator chamber is formed at least partly by outer front and rear walls;

b) said front and rear walls having generally vertically extending lower terminating portions;

c) said sealing lips attached to said lower terminating portions of said front and rear walls to extend downwardly along said outer front and rear walls;

d) said generally vertically extending terminating portions of said front and rear walls being disposed outwardly, relative to said suction nozzle, of the centers of said rollers.

6. The suction nozzle of claim 5 wherein:

a) said elastomeric sealing lips are formed from relatively thin material.

7. The suction nozzle of claim 4 wherein:

a) said rollers are substantially elongated; and b) said sealing lips are also substantially elongated to extend along said rollers.

8. A suction nozzle for a cleaner having:

a) an agitator chamber;

b) a suction opening for said nozzle;

c) at least one roller mounted in said agitator chamber and extending downwardly into said suction opening;

d) said agitator chamber includes an agitator;

e) said roller being disposed outwardly of said agitator;

f) said agitator chamber including sealing means for sealing against said roller to help maintain an envelope of suction within said suction nozzle;

g) said sealing means taking the form of an elastomeric sealing lip engaging resiliently against said roller;

h) said agitator being a brush containing agitator; and i) said roller having a diameter greater smaller than the diameter of said agitator.

9. The suction nozzle of claim 8 wherein:

a) said agitator chamber is formed at least partly by outer front and rear walls;

b) said front and rear walls having generally vertically extending lower terminating portions;

c) said sealing lip attached to one of said lower terminating portions;

d) said one of said terminating portions being disposed outwardly, relative to said suction nozzle, of the center of said roller.

* * * * *